US010996022B1

(12) United States Patent
Golomb

(10) Patent No.: US 10,996,022 B1
(45) Date of Patent: May 4, 2021

(54) FIREARM GRIP APERTURE

(71) Applicant: Mark Joseph Golomb, Flagler Beach, FL (US)

(72) Inventor: Mark Joseph Golomb, Flagler Beach, FL (US)

( * ) Notice: Subject to any disclaimer, the term of this patent is extended or adjusted under 35 U.S.C. 154(b) by 0 days.

(21) Appl. No.: 16/884,393

(22) Filed: May 27, 2020

Related U.S. Application Data

(60) Provisional application No. 62/950,499, filed on Dec. 19, 2019.

(51) Int. Cl.
*F41C 23/16* (2006.01)

(52) U.S. Cl.
CPC ..... *F41C 23/16* (2013.01)

(58) Field of Classification Search
CPC ..... F41C 23/02; F41C 23/16; F41G 11/003
USPC ..... 42/72, 71.01, 104, 85, 90, 106
See application file for complete search history.

(56) References Cited

U.S. PATENT DOCUMENTS

| | | | | |
|---|---|---|---|---|
| 63,303 | A | 3/1867 | Restell | |
| 897,577 | A * | 9/1908 | Bourne | F41C 27/22 42/59 |
| 898,178 | A * | 9/1908 | Bourne | F41G 1/473 42/111 |
| 2015/0121737 | A1* | 5/2015 | Anderson | F41C 23/22 42/72 |
| 2018/0245883 | A1* | 8/2018 | Silvennoinen | F41G 11/003 |
| 2019/0390935 | A1 | 12/2019 | Purkiss | |

FOREIGN PATENT DOCUMENTS

WO W 2011/056361 A2 5/2011

* cited by examiner

*Primary Examiner* — Reginald S Tillman, Jr.

(57) ABSTRACT

A Firearm grip that attaches underneath a handguard and helps stabilize shooting with as little as one finger on the grip. The grip has a rail channel on the top portion, while the lower portion is circular shaped, extending downward and parallel with the firearm barrel. The top and lower portions of the device are one solid piece. The front and back of the circular portion contain separate voids. On each side of the voids are positions to mount a sling clip. A swivel sling attachment can be mounted to the bottom center of the circular portion.

5 Claims, 6 Drawing Sheets

FIREARM GRIP APERTURE

BACKGROUND

Rifles are commonly used for hunting, competitions, and combat situations. This relates to rifle grips, specifically forward vertical grips that allow users to have a comfortable and secure grasp. The vertical grip extends downward below a rifle barrel or handguard which is attached to a barrel. In certain situations quick reloading and taking cover while shooting a rifle is vital for shot placement and the safety of the operator. Improving upon these tasks is extremely important to give the shooter an edge for efficiency.

Typically rifle shooters have two options when holding a rifle. With the first option, the strong hand is placed on the rear of the firearm near the trigger, while the support hand rests twisted in an uncomfortable manner under the barrel. With the second option, the strong hand is placed on the rear of the firearm near the trigger, while the support hand holds onto a vertical handle underneath the barrel. In the case of a forward vertical grip, the user is limited to one option, a full first grasp. Forward vertical grips provide one grasp option which limits the user's accuracy, ability to take cover, stability, and reload time. The long post of a vertical grip hinders the ability of the user to take proper cover behind a wall or solid object. The vertical grip also hinders the user from grasping other objects for stability such as cover, walls, fences, and other solid stabilizing objects. In order to achieve some stability, the rifle user must lean against solid objects in order to provide steady and accurate shot placement. In the case of firing a rifle while leaning against objects, a shooter is still fighting to control recoil.

Efficiency, control, and stability can be improved by holding onto more than one object with the support hand. Furthermore, there is a need for rifle users to change grasping positions with the support hand, as a particular situation commands.

In conclusion, no vertical grip formerly created provides the user with multiple grasping options and the ability to interact with the environment. Therefore, the objective is to provide a rifle user with a versatile device that allows the user to grasp more than one object at the same time with the support hand.

SUMMARY

An improved rifle grip has a circular shaped grip element, which the embodiment easily slides onto a rail underneath the rifle barrel. The circular element portion of the embodiment has multiple points for attaching different types of rifle slings such as a clip connection sling, quick release swivel sling, or tie-on sling. A screw slides through the top side of the grip inside the accessory mounting system, engaging a slot in the rail, and is secured with a nut. The screw prevents the grip from sliding forward or backward on the rail. The circular shape enables the user to hold onto the rifle with a one finger grasp, a full first grasp, or simply rest the circular element on a solid surface. In the case of a one finger grasp, the other four fingers are free to hold onto other objects such as a wall, fence, an extra ammunition magazine or environmental objects. When grasping a wall, fence, or other stabilizing object this creates a more comfortable and stable shooting experience. The shooter is able to utilize the environment as part of their grasp. When grasping an extra magazine for example, this creates a more efficient shooting experience through quicker reloading of the firearm. In turn, the shooter is able to carry a variety of objects while engaging in combat, competitions, or practice.

Accordingly, several advantages include increased reload time during competitions and combat; the ability to hold onto cover and stabilizing objects, the provision of more accurate and stable control when firing the rifle, and to provide the user with multiple grasping options. The grip is contoured in such a way as to provide the shooter with a comfortable secure grip.

DETAILED DESCRIPTION

Figure 1:
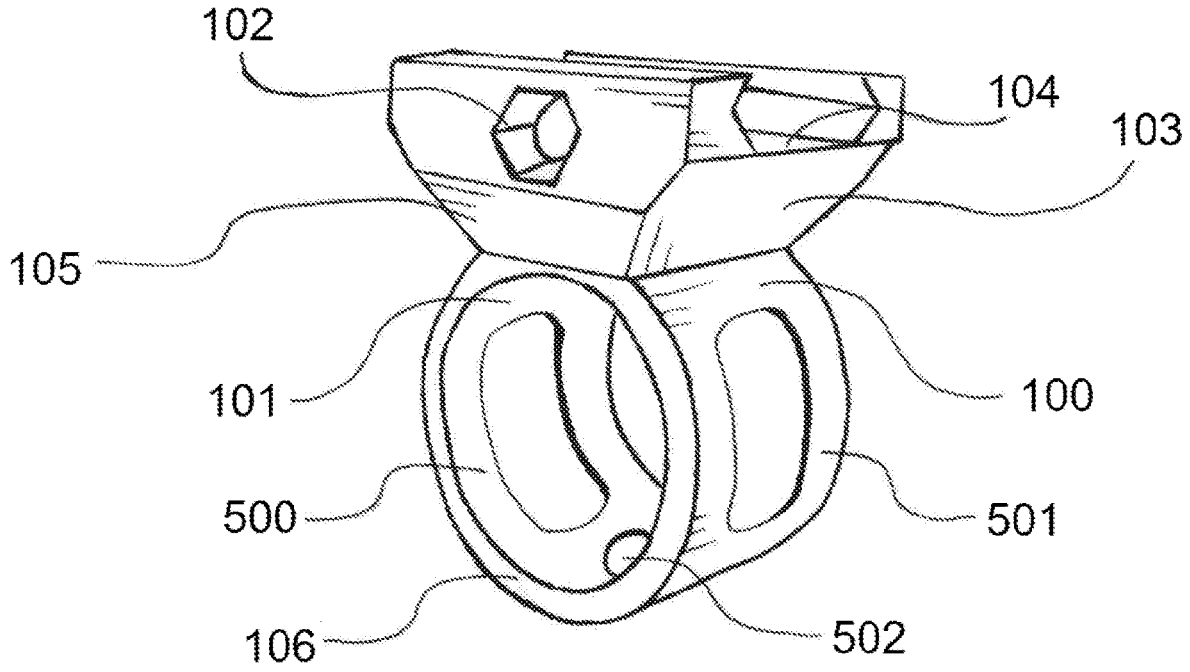
FIG. 1 is a perspective left-side and rear view of the grip

FIG. 1 illustrates the left side and rear side of the device, showing the nut recess 102 which is located above the upper side 105. The upper side 105 and rear upper side 103 acts as a hand stop which keeps the hand positioned on the outer ring 100 when grasped with a full grip. The inner ring 101 may be grasped with the index finger and the other fingers gripped together forming a fist, or the remaining fingers are free to grasp other objects. The outer ring 100 and inner ring 101 provide the shooter with comfort and control while the upper side 105 and the rear upper side 103 prevent the shooters hand from riding too high on the device. Directly below the upper side 105 is the front sling attachment 500, this is the point where a clip-on rifle sling may be connected. Directly below the rear upper side 103 is the rear sling attachment 501 point, where a clip-on rifle sling may be connected. At the base of the circular element a portion of the base sling attachment 502 is visible. The base sling attachment 502 will be described in further detail under the FIG. 5 section below. The grip displayed in FIG. 1-5 shall be formed of a solid material such as metal, aluminum, aluminum alloy, durable plastic, polymer or any rigid material.

Figure 2:
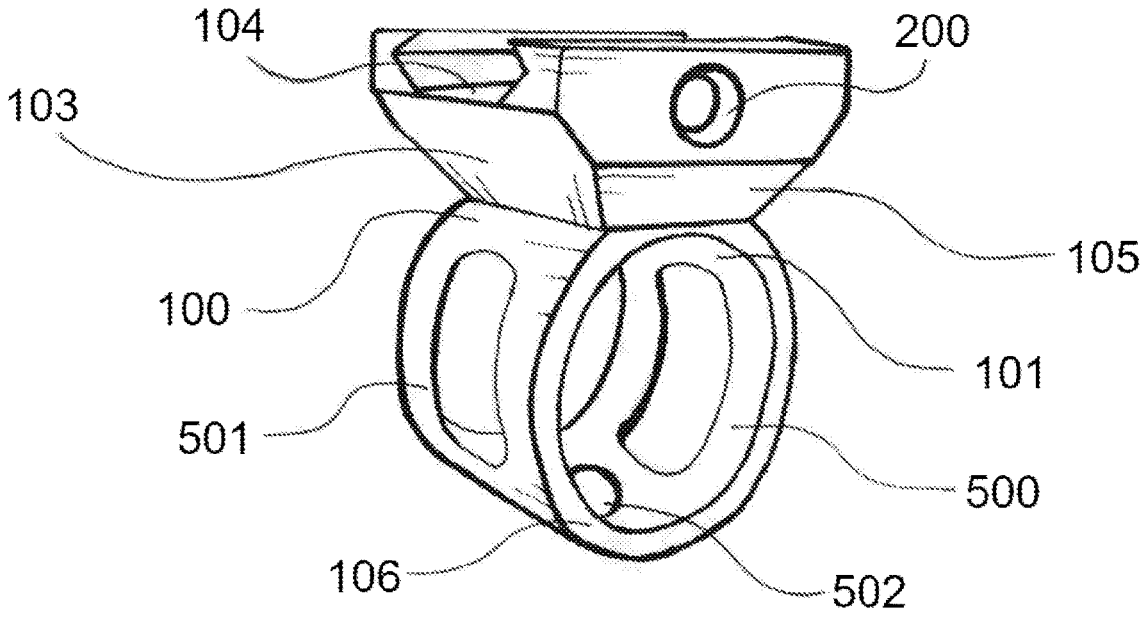
FIG. 2 is a perspective similar to FIG. 1 but showing the right-side view of the grip and rear view.

FIG. 2 right side and rear side view illustrates all the same embodiments of FIG. 1, except FIG. 2 shows a screw recess 200 indentation on the right side.

Figure 3:
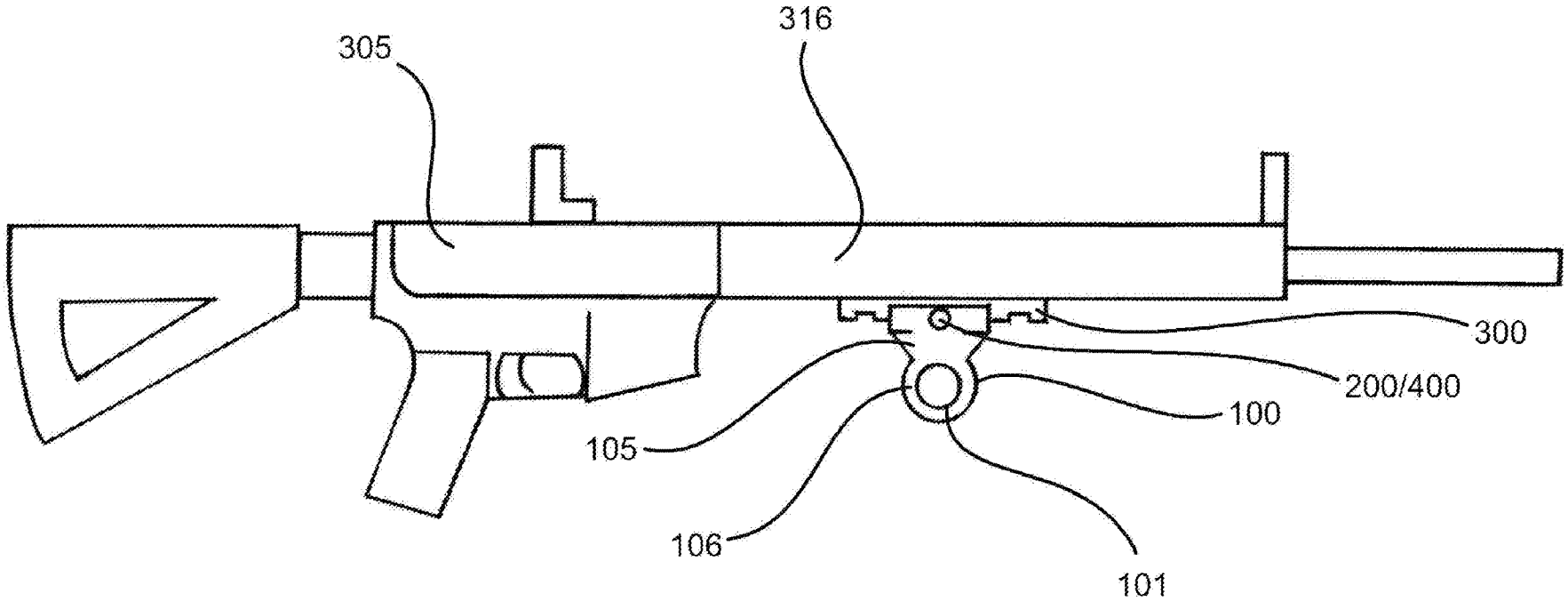
FIG. 3 is a perspective showing the grip mounted to the rifle with a right profile view.

FIG. 3 Illustrates the device attached to the accessory mounting system 300 on a rifle and the rifle to which it is mounted. The rifle shown is conventional which has an accessory mounting system 300 and is made of metal. The accessory mounting system 300 is comprised of rails with slots on top in which to engage accessories. The retaining screw 400 is seated through the screw recess 200 which is slightly larger than the screw 400 for a flush fit. The screw 400 rests in a slot on the accessory mounting system 300. In this illustration the accessory mounting system 300 is an integrated piece attached to the handguard 316. The handguard 316 is rigid and securely mounted to the upper frame 305 of the rifle.

Figure 4:
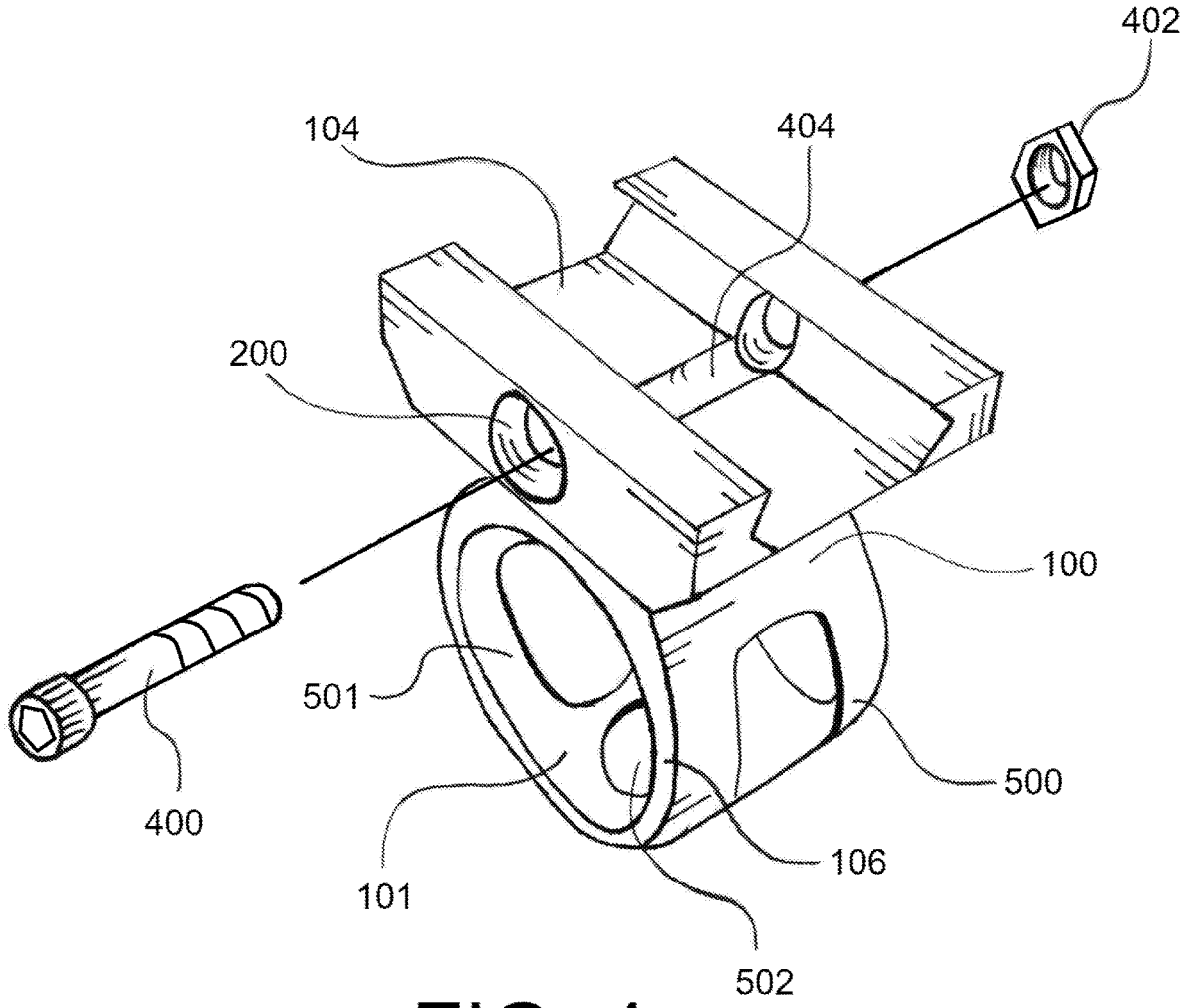
FIG. 4 is an exploded view of the grip, showing all the elements of the embodiment.

FIG. 4 illustrates a top down and front facing view. The view is also an exploded view of the grip and includes all elements of the embodiment. The screw channel 404 provides access for the screw 400 to secure the grip on the rifle and prevent movement. The rail housing 104 is the area that slides onto the accessory mounting system 300 which is shown in FIG. 3. The screw 400 slides into the screw recess 200 resting on the screw channel 404 and engaging the nut 402. The circular element 106 contains the outer ring 100, inner ring 101, rear sling attachment 501, front sling attachment 500, and base sling attachment 502. The circular element's 106 outer ring 100 and inner ring 101 are domed shape to provide comfort and conformity for the average human hand. At the base of the circular element 106, a portion of the base sling attachment 502 is visible.

Figure 5:
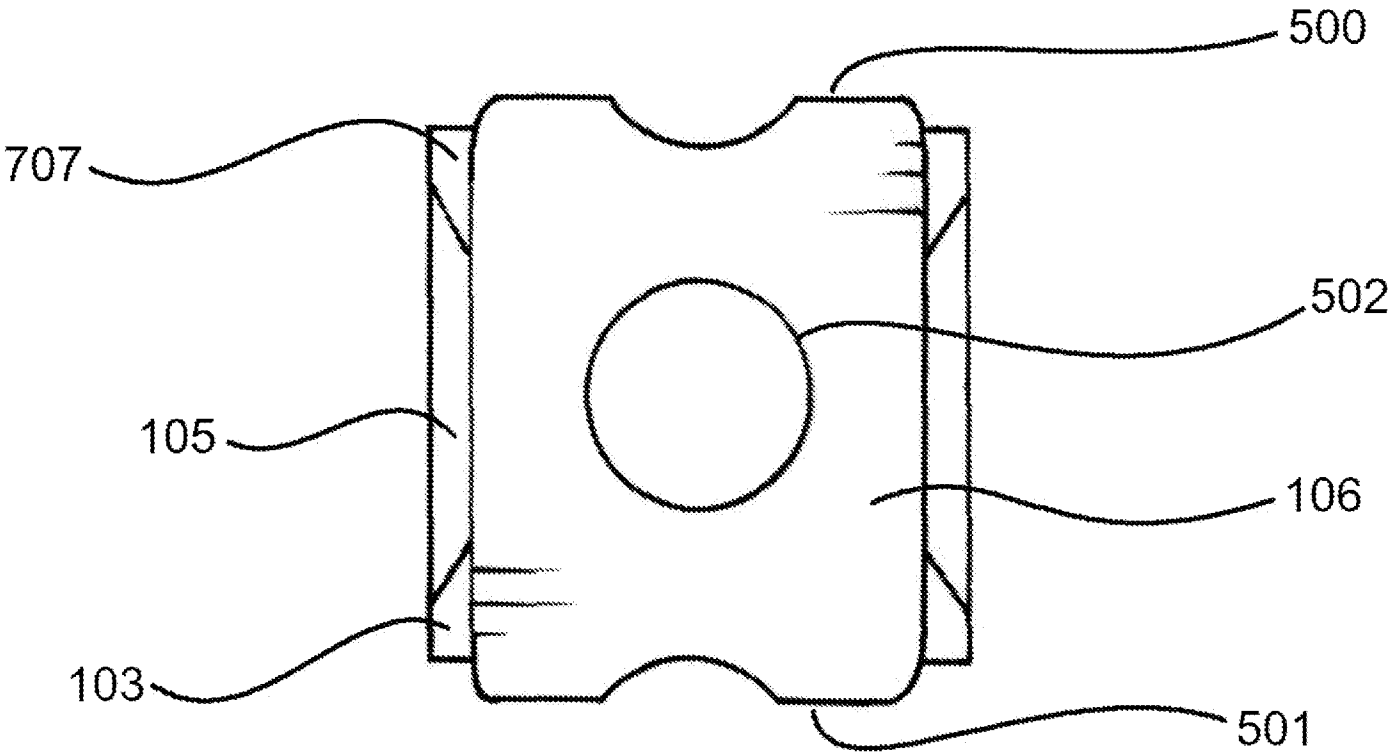
FIG. 5 is a view of the bottom of the circular element, also visible are the upper sides and base sling attachment.

FIG. 5 illustrates a view of the bottom of the embodiment. In the center is the base sling attachment 502. The base sling attachment 502 is the place for connecting a quick release swivel sling. In this illustration you can also see the lower portions of the front clip sling attachment 500 on the top, and the rear clip sling attachment 501 on the bottom.

Figure 6:
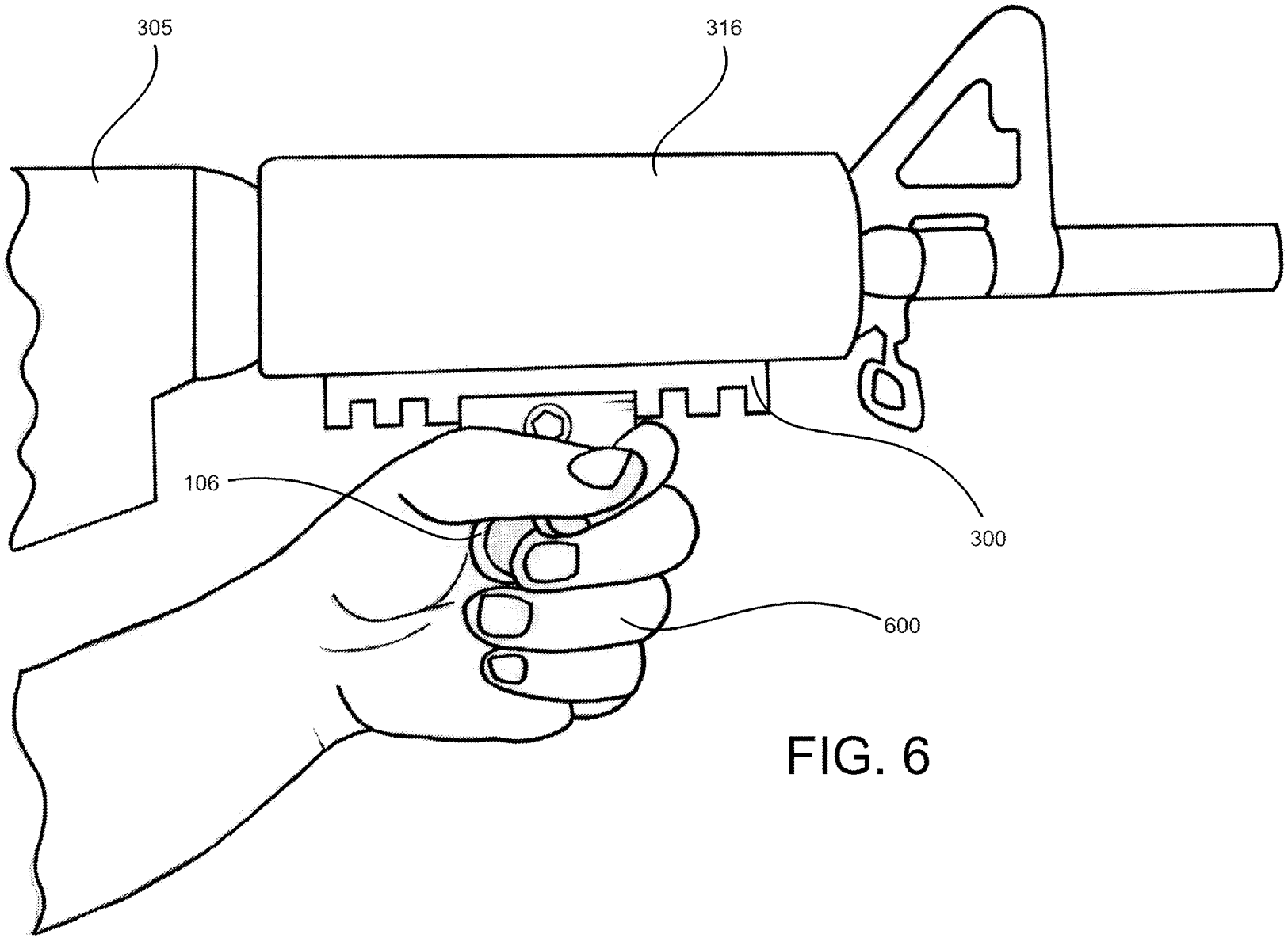
FIG. 6 is a profile view of the support hand grasping the outside of the circular element. Also shown is a profile view of a truncated rifle.

FIG. 6 illustrates a truncated rifle and truncated human arm with the support hand 600 grasping the outside of the circular element 106. This figure demonstrates operational use, whereas the webbing between the thumb and the index finger rests on the rear upper side 103 of the device. As pictured, the rest of the fingers on the support hand 600 are curled around the circular element 106, while some fingers fold back to the palm of the support hand 600. The upper frame 305 of the rifle has been truncated to show greater close-up detail with regard to the support hand 600 grasping the circular element 106.

Figure 7:
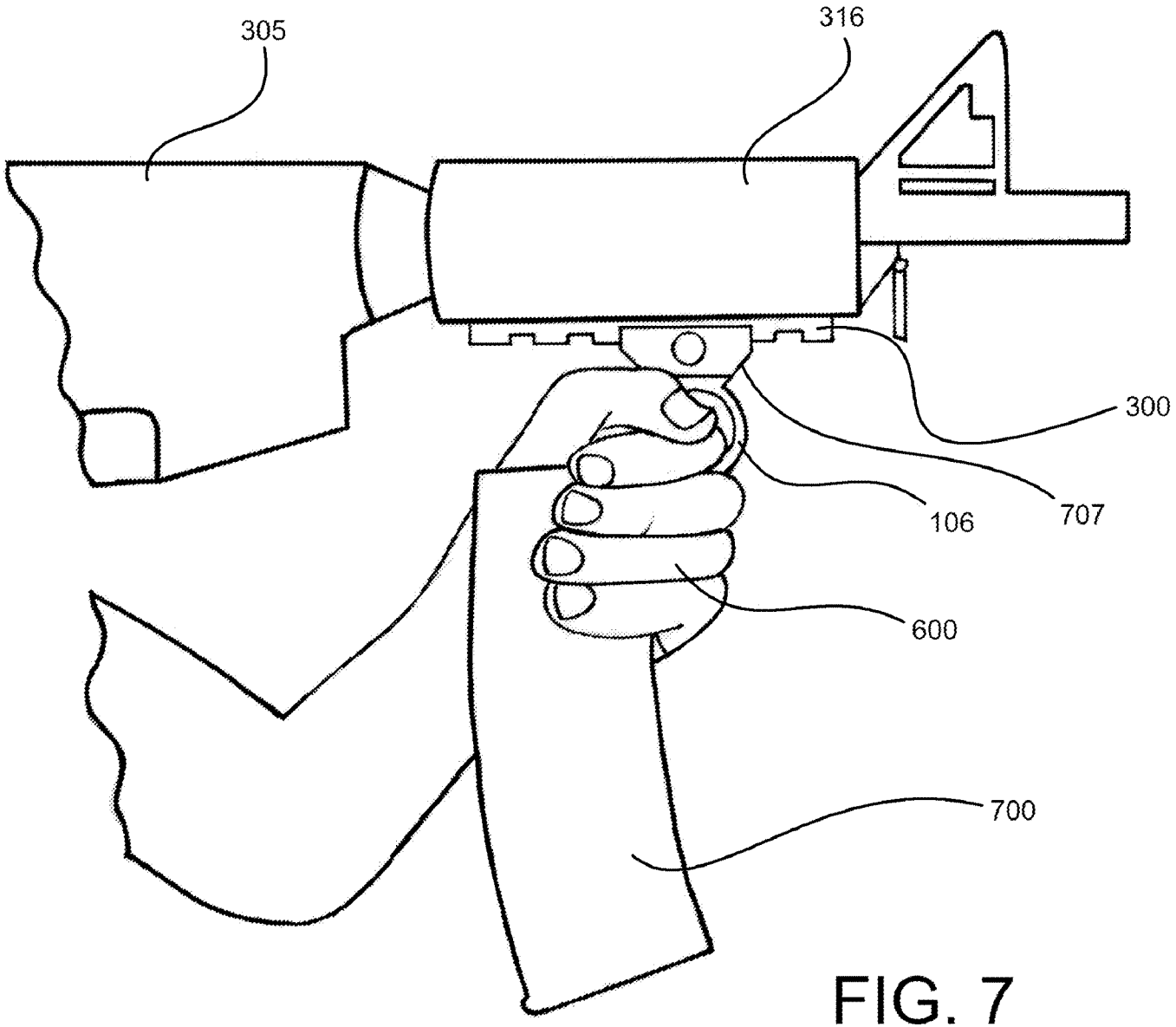
FIG. 7 is a profile view of the support hand with an ammunition magazine and a truncated rifle.

FIG. 7 illustrates a similar view to FIG. 6 whereas both are profile views demonstrating operational use. Here you can see the index finger of the support hand 600 is through the center of the circular element 106, thereby allowing the remaining fingers to clutch the pictured ammunition magazine 700. Just like FIG. 6, FIG. 7 displays a truncated upper frame 305 on the rifle. The arm for the support hand 600 has also been truncated. A profile view of the front upper side 707 is shown. Please note that there is no difference between the rear upper side 103 and the front upper side 707, except that each location has been designated as such. The firearm grip aperture is symmetrical and can slide on the accessory mounting system 300 backwards or frontwards and will not diminish performance.

Though the above device in the description is meant for use with M16 and Ar-15 type rifles, the device will attach to any firearm with an accessory mounting system, also known as a 1913 picatinny rail. Also note that any firearm with capabilities to attach such a rail will also be able to incorporate the above mentioned device to the firearm. It is therefore the intent not to limit the device to the description above with regard to the accessory mounting system. All accessory mounting systems may be considered during manufacturing such as 1913 picatinny, Keymod, and M-lok™ systems. In this regard and with other accessory mounting systems to be considered; the upper side 105, rear upper side 103, and rail housing 104, may be modified to directly connect to other types of accessory mounting systems. Also any rigid and durable material is suitable for use in the embodiment. In the case of machining metal and more specifically aluminum, passivation should be applied to the embodiment. The materials listed in this specification are preferred materials that are readily available. The embodiment is one solid piece with the exception of the retaining screw 400 and the nut 402. The preferred method of manufacturing is to mill aluminum using a computer numerical control router. As technology progresses the use of new materials may be employed in the creation of the embodiment.

Anyone with knowledge in the art of machining metal, plastics molding and manufacturing will be able to reproduce the aforementioned device using conventional machining practices, computer numerical control routers, forging, injection molding processes, or any other common manufacturing methods.

I claim:

1. A firearm grip aperture comprising:

an upper section and lower section, the center of both sections being aligned along a vertical axis;

the upper section comprising a body having a dovetail slot along the length of the body, the dovetail slot being configured to attach to a rail of a firearm;

the upper section further comprising aligned apertures on the right and left sides of the body, the apertures being configured for receiving a fastener;

the lower section comprising a cylindrical ring-shaped body having circular openings on each end, each opening facing a direction perpendicular to the longitudinal axis of the upper section, the openings being configured to receive a finger of a shooter; the ring-shaped body further comprising at least three elongated slots along the outer surface of the ring-shaped body, the slots being configured to receive a rifle sling or a swivel sling.

2. The firearm grip aperture of claim 1, wherein the body of material is composed of aluminum.

3. The firearm grip aperture of claim 1, wherein the body of material contains passivation.

4. The firearm grip aperture of claim 1 further comprising a screw that passes through the upper portion of the firearm grip aperture.

5. The circular element of claim 1, wherein that such an element contains an outer and inner ring of a predetermined size.

* * * * *